US009045699B2

(12) United States Patent
Brecher et al.

(10) Patent No.: US 9,045,699 B2
(45) Date of Patent: Jun. 2, 2015

(54) HYDROCARBONACEOUS MATERIAL UPGRADING METHOD

(75) Inventors: Lee E. Brecher, Laramie, WY (US); Charles G. Mones, Cheyenne, WY (US); Frank D. Guffey, Laramie, WY (US); Phyllis J. Brecher, legal representative, Laramie, WY (US)

(73) Assignee: The University of Wyoming Research Corporation, Laramie, WY (US)

( * ) Notice: Subject to any disclaimer, the term of this patent is extended or adjusted under 35 U.S.C. 154(b) by 938 days.

(21) Appl. No.: 13/154,277

(22) Filed: Jun. 6, 2011

(65) Prior Publication Data

US 2011/0284425 A1 Nov. 24, 2011

Related U.S. Application Data

(63) Continuation-in-part of application No. 11/792,518, filed as application No. PCT/US2005/044160 on Dec. 6, 2005, now Pat. No. 7,976,695.

(60) Provisional application No. 60/633,744, filed on Dec. 6, 2004, provisional application No. 60/633,856, filed on Dec. 6, 2004.

(51) Int. Cl.
*C10G 9/00* (2006.01)
*C10G 51/02* (2006.01)

(52) U.S. Cl.
CPC ..... *C10G 9/007* (2013.01); *C10G 51/023* (2013.01); *C10G 2300/1025* (2013.01); *C10G 2300/1033* (2013.01); *C10G 2300/302* (2013.01); *C10G 2300/308* (2013.01)

(58) Field of Classification Search
CPC ..... C10G 9/00; C10G 9/005; C10G 9/007; C10G 9/06; C10G 9/34; C10G 9/35; C10G 9/36; C10G 1/002; C10G 31/06; C10G 51/023; C10G 55/024
USPC ..... 208/100, 102, 105, 130, 131, 49, 50, 67
See application file for complete search history.

(56) References Cited

U.S. PATENT DOCUMENTS 1,817,926 A 8/1931 McIntire
2,335,551 A 11/1943 Trow (Continued)

FOREIGN PATENT DOCUMENTS

CA 2153395 2/1999
WO 95/13338 5/1995

(Continued)

OTHER PUBLICATIONS

International Application No. PCT/US05/44160, International Search Report dated Apr. 11, 2008.

(Continued)

*Primary Examiner* — Michelle Stein
*Assistant Examiner* — Brandi M Doyle
(74) *Attorney, Agent, or Firm* — Santangelo Law Offices, P.C.

(57) ABSTRACT

A hydrocarbonaceous material upgrading method may involve a novel combination of heating, vaporizing and chemically reacting hydrocarbonaceous feedstock that is substantially unpumpable at pipeline conditions, and condensation of vapors yielded thereby, in order to upgrade that feedstock to a hydrocarbonaceous material condensate that meets crude oil pipeline specification.

35 Claims, 4 Drawing Sheets

(56) References Cited

U.S. PATENT DOCUMENTS

| | | | | | |
|---|---|---|---|---|---|
| 2,657,120 | A | | 10/1953 | Bigsby et al. | |
| 3,369,992 | A | * | 2/1968 | Henke et al. | 208/14 |
| 3,700,587 | A | * | 10/1972 | Hyde | 208/131 |
| 4,125,437 | A | | 11/1978 | Bacon | |
| 4,200,517 | A | | 4/1980 | Chalmers et al. | |
| 4,208,251 | A | | 6/1980 | Rasmussen | |
| 4,219,405 | A | | 8/1980 | Pietzka | |
| 4,233,138 | A | | 11/1980 | Rollmann et al. | |
| 4,356,078 | A | | 10/1982 | Heavin et al. | |
| 4,443,328 | A | * | 4/1984 | Sakurai et al. | 208/106 |
| 4,504,377 | A | | 3/1985 | Shu et al. | |
| 4,822,479 | A | | 4/1989 | Fu et al. | |
| 5,110,447 | A | * | 5/1992 | MacWilliams et al. | 208/106 |
| 5,259,945 | A | | 11/1993 | Johnson, Jr. et al. | |
| 5,318,697 | A | | 6/1994 | Paspek et al. | |
| 5,645,712 | A | | 7/1997 | Roth | |
| 5,653,865 | A | | 8/1997 | Miyasaki | |
| 5,753,086 | A | | 5/1998 | Guffey et al. | |
| 5,755,389 | A | | 5/1998 | Miyasaki | |
| 5,836,524 | A | | 11/1998 | Wang | |
| 6,972,085 | B1 | | 12/2005 | Brecher | |
| 2004/0069682 | A1 | * | 4/2004 | Freel et al. | 208/126 |
| 2008/0093259 | A1 | | 4/2008 | Brecher | |

FOREIGN PATENT DOCUMENTS

| | | | |
|---|---|---|---|
| WO | WO 95/13338 | * | 5/1995 |
| WO | 01/38458 | | 5/2001 |
| WO | 2007/027190 | | 3/2007 |

OTHER PUBLICATIONS

International Application No. PCT/US05/44160, Written Opinion of the International Searching Authority dated Apr. 11, 2008.
Giles, K. A. Fundamentals of Petroleum Refining, 2010.
U.S. Appl. No. 60/167,337, "Methods and Apparatus for Heavy Oil Upgrading", filed Nov. 24, 1999.
U.S. Appl. No. 60/167,335, "Methods and Apparatus for Improved Pyrolysis of Hydrocarbon Products", filed Nov. 24, 1999.
U.S. Appl. No. 60/633,856, "Methods and Apparatus for Producing Heavy Oil from Extra-Heavy Feed Oils", filed Dec. 6, 2004.
U.S. Appl. No. 60/633,744, "Distillate Recovery Methods and Apparatus for Oil Processing Applications", filed Dec. 6, 2004,
Parent U.S. Appl. No. 11/792,518, filed Jun. 6, 2007.

* cited by examiner

HYDROCARBONACEOUS MATERIAL UPGRADING METHOD

CROSS-REFERENCES TO RELATED APPLICATIONS

This application is a continuation-in-part of, and claims priority to, U.S. patent application Ser. No. 11/792,518, filed 6 Jun. 2007, published as US2008/0093259 on 24 Apr. 2008, and issued on 12 Jul. 2011 as U.S. Pat. No. 7,976,695, which itself is a United States national phase application of, and claims priority to, international patent application PCT/US2005/044160, filed 6 Dec. 2005, published as WO 2007/027190 A2 on 8 Mar. 2007, said international application claiming priority to each: U.S. Provisional Application 60/633,744, filed 6 Dec. 2004, and entitled "Distillate Recovery Methods and Apparatus for Oil Processing Applications"; and U.S. Provisional Application 60/633,856, filed 6 Dec. 2004, and entitled "Methods and Apparatus for Producing Heavy Oil From Extra-Heavy Feed Oils", each of all said applications, including any publications thereof, and patents incorporated herein by reference in their entirety.

STATEMENT REGARDING FEDERALLY SPONSORED RESEARCH

This invention was made with federal government support under Cooperative Agreement No. USDOE contract DE-FC26-98FT40323 awarded by the United States Department of Energy. The federal government may have certain rights in this invention.

BACKGROUND OF THE INVENTION

Western Research Institute developed the following WRITE technology for upgrading substantially unpumpable heavy oils, such as bitumen, to pipeline ready, diluent-free "crude" oil that meets crude oil pipeline specification. The term substantially unpumpable refers to materials with pour points so high that they are not pumpable under normal pipeline conditions but may be pumpable under conditions of high temperature or when significantly diluted with, for example, low molecular weight hydrocarbons.

Generally, this inventive technology relates to hydrocarbonaceous material (e.g., oil) processing methods and apparatus. More specifically, specific aspects of the technology relate to the use of thermal environments, perhaps each as part of a stage in a multi-stage processing apparatus and perhaps each adapted to continuously process an oil input (including a hydrocarbonaceous bottoms output by an upstream stage). Such oil input may be heated for a residence time and at a specific temperature. Such may increase the amount of vapors emitted as compared with conventional processing technologies, in addition to affording enhanced control over oil processing operations by providing a highly tunable system.

BACKGROUND

It is well known that oil is a critical commodity for modern societies. To meet this need, oil production is engaged in on a worldwide basis under a variety of conditions and using a variety of techniques. Petroleum reserves (e.g., extra heavy oil and bitumen) that were once passed over in favor of easier to extract reserves are now receiving considerably more attention than in the past, and in fact are the target of many extraction efforts in Canada and elsewhere. Indeed, the continued development of oil production techniques to increase the economic efficiency of oil production may be a constant goal of the oil production industry.

As is well known, crude oil and partially refined oil often may consist of two or more physical and/or chemical components or constituents. In many oil production applications, it may be desirable to process an oil so as to separate out such various physical and/or chemical constituents. Such separation may be desirable to recover oil components with separate uses that may have independent commercial value and/or to produce an oil at a well site that can be pumped for further processing elsewhere.

A key aspect of conventional oil production practices may be transporting oil by pumping it through pipelines. However, extra-heavy oils may not be able to be pumped in existing pipelines in their natural state due to their high densities and kinematic viscosities. Rather, these oils usually must be processed into pipeline-ready heavy oils. Pipeline-ready heavy oils may be defined as those having, at pipeline temperatures, densities above 19 degrees API and kinematic viscosities below 350 centistokes. Conventional techniques for processing extra-heavy oils into pipeline-ready heavy oils typically involve mixture with either natural gas condensate or lighter hydrocarbons to produce a blended oil that can be pumped. However, using the methods and apparatus of this disclosure, the need for a diluent to produce a blended oil may be eliminated and a directly pumpable oil may be produced instead.

BRIEF SUMMARY OF THE INVENTION

Methods and apparatus are disclosed for possibly producing pipeline-ready heavy oil from substantially non-pumpable oil feeds. The methods and apparatus may be designed to produce such pipeline-ready heavy oils in the production field. Such methods and apparatus may involve thermal soaking of liquid hydrocarbonaceous inputs to generate, at least through some chemical reaction, an increased distillate amount as compared with conventional boiling technologies. The hydrocarbonaceous material upgrading method may be characterized as involving a novel combination of heating, vaporizing and chemically reacting hydrocarbonaceous feedstock that is substantially unpumpable at pipeline conditions, and condensation of vapors yielded thereby, in order to upgrade that feedstock to a hydrocarbonaceous material condensate that meets crude oil pipeline specification.

Accordingly, an object of the inventive technology may be the separation via physical and/or chemical processes of physical and/or chemical constituents of an oil.

Another object of the inventive technology may be to accomplish such separation using methods and apparatus involving thermal environment(s) in which an oil may be heated to a certain temperature for a residence time.

Still another object of the inventive technology may be a novel method of generating a pumpable oil (e.g., heavy oil) from a substantially non-pumpable oil (e.g., extra heavy oil or bitumen). Of course, such pumpable oil can be said to meet crude oil pipeline specification. It is of note that where a material, such as oil, for example, exceeds a specification or other index, such material meets such specification or index.

Another object of the inventive technology may be to increase vapor yields as compared with conventional oil processing technologies.

A further object of the inventive technology may be to provide such distillate recovery in conjunction with the use of methods and apparatus for producing heavy oil from non-pumpable oil feeds.

Yet another object of the inventive technology may be to provide a feed to a continuous coker.

Naturally, further objects of the inventive technology are disclosed throughout other areas of the specification, and claims when presented.

DESCRIPTION OF PREFERRED EMBODIMENTS

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

This "WRITE" technology comprises a reactor unit that involves a low severity treatment of feedstock that may be followed by a high severity treatment of bottoms that may involve coking from low severity processing (where severity relates to the degree of temperature, such as reactor or coker temperature, as appropriate, and reaction time). The following discussion of results pertains to a type of low severity processing of WRITE. This low severity processing typically occurs in what we term as the distillate recovery unit (DRU). A test program was conducted in a custom-designed 5-bbl/day DRU reactor facility with the objective of determining operating conditions of commercial interest for scaling the WRITE-DRU to a field-scale demonstration facility.

Figure 1:
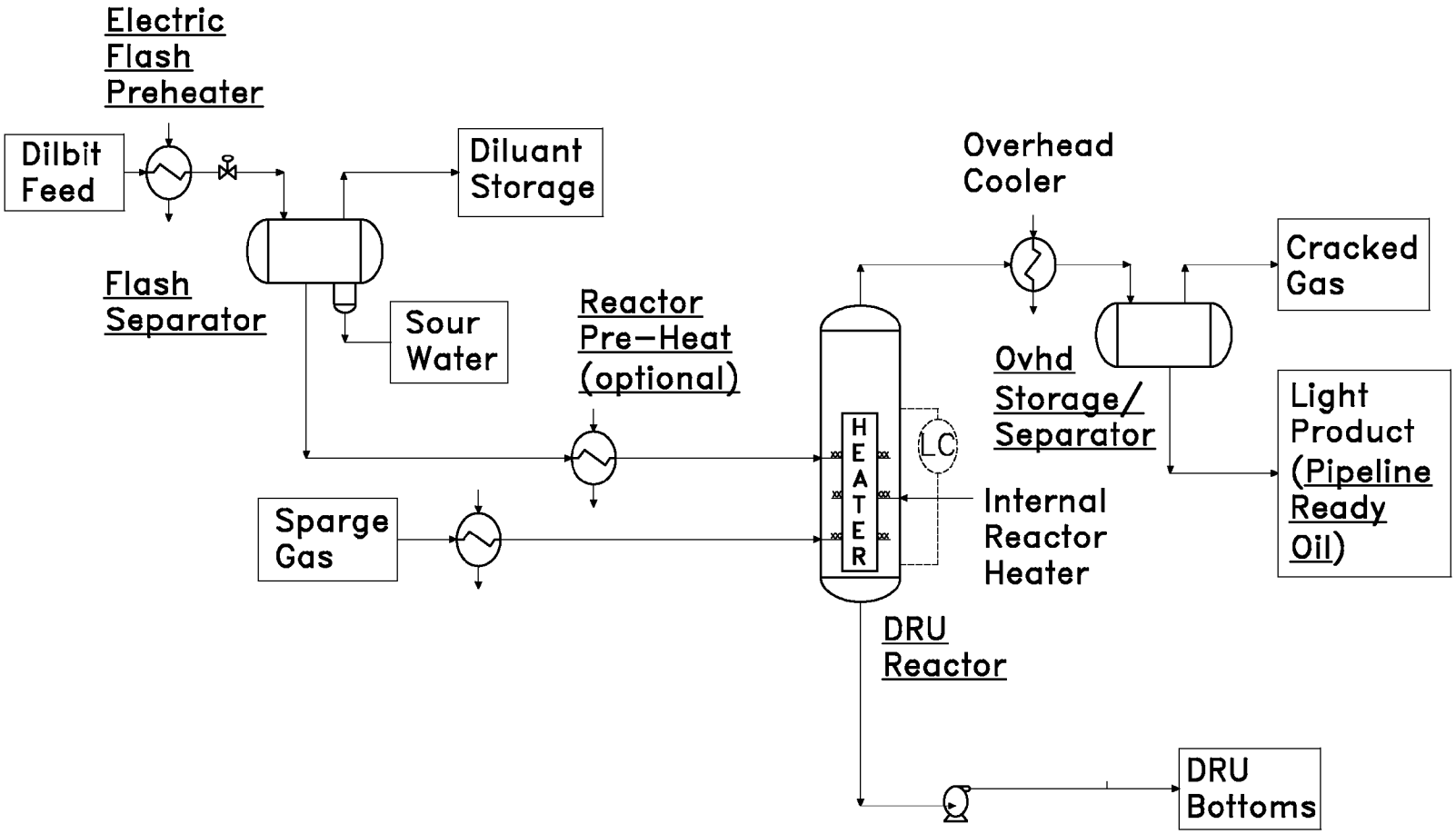
FIG. 1 shows a schematic of 5-bbl/day DRU reactor with internal reactor heater, as may be found in at least one embodiment of the inventive technology.
Figure 2:
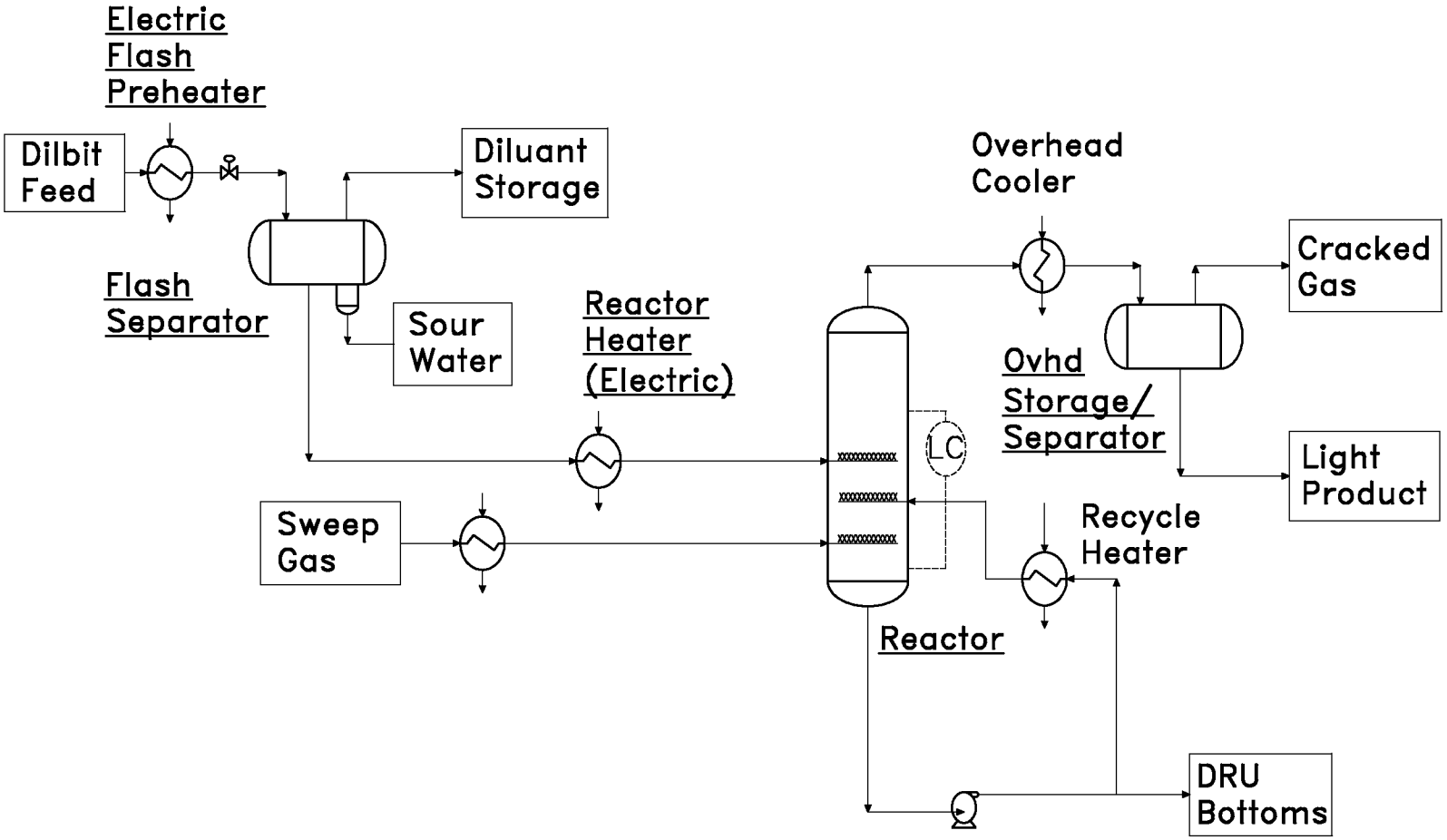
FIG. 2 shows a schematic of 5-bbl/day DRU reactor with external heater, as may be found in at least one embodiment of the inventive technology.

Approximately 30 test campaigns were conducted to characterize the performance of the DRU and to determine a range of potential operating conditions of commercial interest for upgrading substantially unpumpable (at pipeline conditions) hydrocarbonaceous feedstock (bitumen, as but one example) into a pipeline ready oil. Testing was done in a 5-bbl/day pilot-scale reactor system (FIG. 2) that utilized the same fundamental processing steps as would be found in the larger scale, commercial bitumen upgrading facility (that features the inventive WRITE technology). The system was configured slightly differently to permit internal and external heating of the reactor as shown in FIGS. 1 and 2. Because of the similarity to commercial-scale unit operations and the increased throughput capability, it was expected that results from the 5-bbl/day unit would provide more pertinent information for scaling to a field-scale demonstration facility than would earlier results obtained from the 1-bbl/day bench scale unit in which initial testing of the WRITE technology was performed.

The reactor configuration shown in FIG. 1 represents one possible version of the DRU reactor system in which the heater is inside the reactor. This internally heated reactor scheme is similar in concept to the 1-bbl/day reactor configuration used in bench-scale testing. A slightly different version of the system, in which process heat is supplied from outside the reactor, is shown in FIG. 2. This configuration employs one external heater to heat the bitumen feedstock before it enters the reactor and one recycle heater to supply additional process heat as necessary. It is of note that either one or more heaters may be used (one of which may be a recycle heater).

One embodiment of the 5-bbl/day reactor system operated as follows: Diluted bitumen (dilbit) was continuously fed first to flash vaporization equipment that separated the diluent from the bitumen. Subsequently, the bitumen flowed to a pre-heater stage, and then to the DRU reactor. The liquid hydrocarbonaceous material contained in the DRU was constantly sparged with natural gas. The processing that occurred in the DRU involved at least low-to-medium severity pyrolysis reactions. At the DRU temperature and pressure conditions, the low boiling fraction of the bitumen feedstock vaporized (due to heating at least to a first hydrocarbonaceous material constituent boiling point temperature. In addition, lower molecular weight hydrocarbons that resulted from chemical reactions (such as pyrolysis, for example) would volatilize (vaporize). The vapors (e.g., including a first vapor mass from the vaporization and a second mass from the chemical reaction) together have a combined partial pressure. The mixture of these two vaporized streams exited, partially from the motive action of the sparge gas, as vapor from the top of the reactor where it was condensed by cooling and stored as condensate. This condensate substantially represents the pipeline ready oil or a component of that blended product. The heavy residual bottoms fraction (liquid hydrocarbonaceous material bottoms, resulting, at least in part, from the chemical reaction) was removed from the reactor as a high temperature liquid that was pumped from the reactor to tank storage. In certain embodiments, an antifoaming agent may be added to the reactor.

It is of note that preferably, the process is continuous (as opposed to batch mode), such that steps of inputting the feedstock, removing the vapors, and removing the bottoms (and perhaps other steps) are performed continuously.

As discussed earlier, FIGS. 1 and 2 represent slightly different reactor configurations with internally and externally supplied reactor heat, respectively. The internally heated reactor scheme employed a stab-in heater for the reactor vessel. The externally heated scheme used pre-heat and recycle heaters located external to the reactor vessel. The configuration that used the stab-in heater allowed more precise control of reaction rates that ultimately resulted in bitumen conversion to relatively high percentages of upgraded oil at comparatively low levels of process severity. Additional work with the externally heated reactor system should result in a set of operating conditions that yield similar results. It is of note that either one or more heaters may be used (one of which may be a recycle heater).

The chemical reactions and vaporization that occur in the DRU occur most optimally at low operating pressures (e.g. vacuum to 35 psig). The DRU design specifies the use of low pressures to promote the rapid evolution and removal of reaction products before they can decompose. The chemical reactions and vaporization occur under an operating pressure that is compatible with ancillary equipment that is external of the reactor. Indeed, too high or too low an operating pressure may cause dysfunction of ancillary equipment (e.g., equipment that processes and/or conveys said input feed and effluent streams to and from the reactor) that is external of the reactor. As such, the exact allowable operating pressure range will depend on the specific particulars of a design. Given a particular design (i.e., the ancillary equipment it uses), such pressure range would be easily determinable by one of ordinary skill in the art.

It is of note that the bottoms from one stage may be used as the input for a second stage. Further, multistage apparatus may be used to produce different streams (e.g., bottoms, vapors, condensate) that may be combined.

Figure 3:
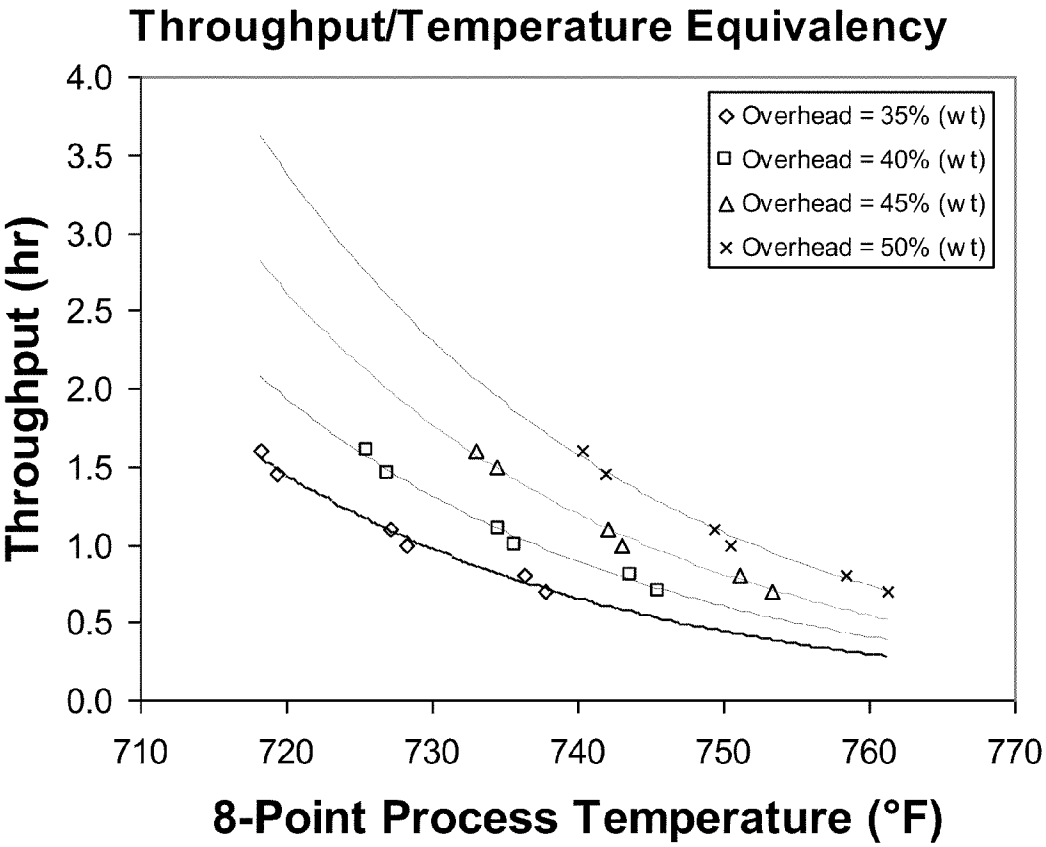
FIG. 3 shows a possible relationship between temperature, residence time and oil product in the DRU, as may be seen in at least one embodiment of the inventive technology.

Temperature-residence time determinations: Temperature-residence-time tests may determine the oil production, reported as percent of feed weight, as a function of temperature and residence time, the latter being related to bitumen (feedstock) feed or input rate, and quantity of liquid holdup in the reactor. Liquid holdup refers to liquid that resides in the reactor. This is an independent variable (in that it was, during tests, adjustable) that is specified as part of test conditions and relates to residence time. The 5-bbl/day DRU was operated under steady state conditions in what we presumed was an ideal, continuously stirred (i.e. backmixed) reactor (CISTR) configuration. Residence time may be set by specifying either feed rate or the mass of liquid in the reactor or both. For a CISTR, the residence time may be calculated by dividing the volume of liquid in the reactor by the average of volumetric input and output (bottom removal) rates, in which the composition of the bottoms stream exiting the reactor may be identical to the liquid contained in the reactor. The reactor's liquid volume may be determined by dividing the mass of liquid in the reactor by the density of the bottoms. Unfortunately, these volumetric calculations required values for bottoms and bitumen density that have not been accurately determined for the high reactor temperatures that exist in the DRU. Absent high temperature information, calculations were made using extrapolations of literature data from lower temperature. Alternatively, we eliminated the requirement for density by calculating residence time based on mass. This method essentially assumed that the high-temperature densities of bitumen and bottoms were identical. Given the uncertainty in determining density, our estimates for calculated residence times are no more accurate than plus or minus 20%. Ultimately, tracer tests should provide the most accurate values for liquid residence time. This type of analysis will be conducted in the future for specific tests of greatest commercial interest. Notwithstanding the uncertainties discussed above, the data in FIG. 3 provides a reasonable relationship between temperature, overhead condensate yield (oil production), and residence time. These results are similar in relationship to those from the 1-bbl/day bench-scale unit but are shifted to shorter residence times by employing higher reactor temperatures.

Figure 4:
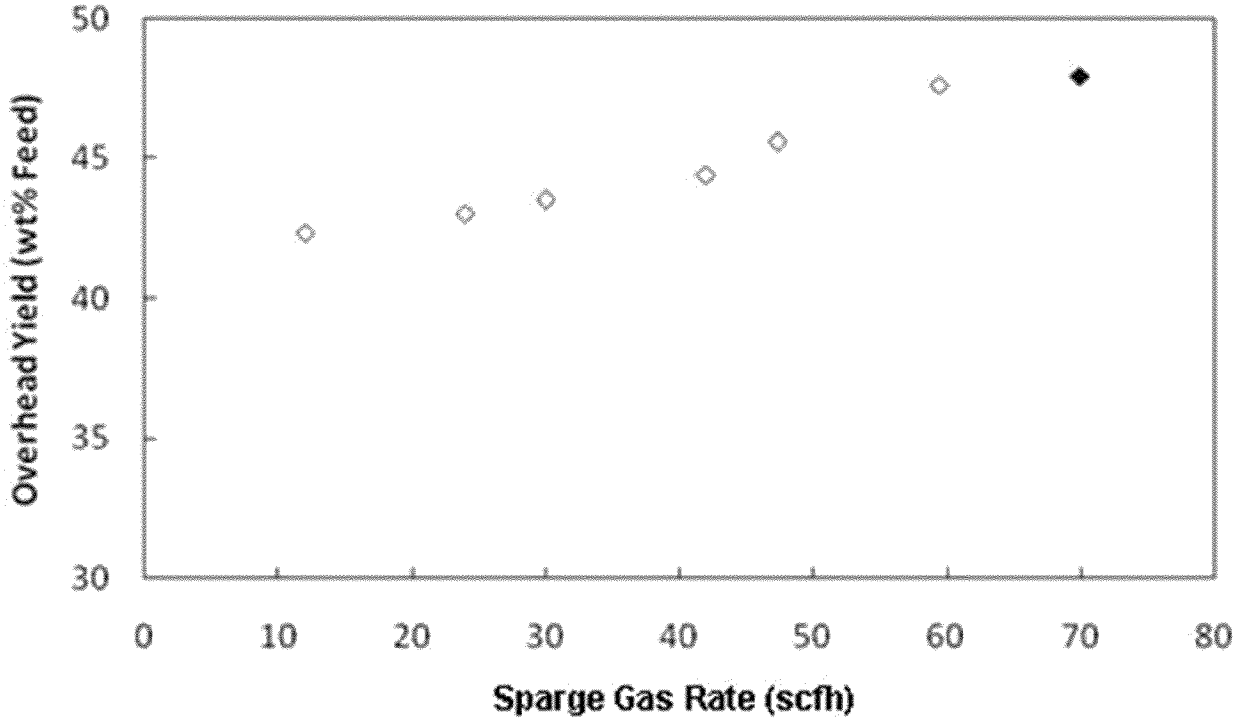
FIG. 4 shows the expected increase in overhead yield with increase in sparge gas rate admitted to DRU, as may be seen in at least one embodiment of the inventive technology.

Effect of sparge gas rates on oil production: As expected, the DRU produced a vapor stream that had lower average molecular weight and lower average boiling point than the parent bottoms and feed material. Admitting a sparge gas to the DRU benefited the process by sweeping the vapor-phase products out of the reactor. We also postulated that sparging through the liquid bottoms would be advantageous for removing the relatively lower molecular weight, but still potentially reactive, material from a reactive environment before it can decompose. We further postulated that a lowering of reactor partial pressure (e.g., the combined partial pressure of the masses of vapors) that results from increased sparge rate in excess of the amount needed to sweep vapors from the reactor would result in the production of even heavier but still valuable hydrocarbon components and even more production of oil yield. FIG. 4 shows the increase in overhead production (pipeline ready oil product) with increased rate of sparge gas admitted to the DRU. Note the increase in overhead production with increased sparge gas.

It should be noted that natural gas was used as sparge gas in testing of the 5-bbl/day DRU reactor. In commercial use, this sparge gas may be any number of available non-condensable gases such as carbon monoxide, carbon dioxide, methane, nitrogen, and hydrogen (as but a few of many possible sparge gases). These gases may react to some degree with the hydrocarbonaceous species that are present and may improve the quality of the pipeline ready oil product.

Conclusions: The 5-bbl/day DRU facility provided useful information for thermally upgrading unpumpable bitumen at higher temperatures, but still at relatively mild severities. We have demonstrated that pumpable oil of quality equaling or exceeding earlier testing in the 1-bbl/day unit can be produced at reduced residence time by using higher processing temperatures. Reducing residence time is beneficial for commercial implementation of the WRITE technology because of reduced equipment size. We have also demonstrated that increased sparge gas rate increases oil yield. All of this information is useful for designing a field-scale demonstration facility.

As can be easily understood from the foregoing, the basic concepts of the present invention may be embodied in a variety of ways. It involves both hydrocarbonaceous material upgrading techniques as well as devices to accomplish the appropriate hydrocarbonaceous material upgrading. In this application, the upgrading techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "heater" should be understood to encompass disclosure of the act of "heating"—whether explicitly discussed or not—and, conversely, were there effectively disclosure of the act of "heating", such a disclosure should be understood to encompass disclosure of a "heater" and even a "means for heating." Such changes and alternative terms are to be understood to be explicitly included in the description. Further, each such means (whether explicitly so described or not) should be understood as encompassing all elements that can perform the given function, and all descriptions of elements that perform a described function should be understood as a non-limiting example of means for performing that function.

Any patents, publications, or other references mentioned in this application for patent are hereby incorporated by reference, including all priority documents (including PCT Pub. No. WO 2007/027190 and U.S. Patent App. Publication No. US2008/0093259. Any priority case(s) claimed by this application, including any Exhibits or Appendices of such priority case(s) is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the upgrading devices/systems as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) an apparatus for performing the methods described herein comprising means for performing the steps, xii) the various combinations and permutations of each of the elements disclosed, xiii) each potentially dependent claim or concept as a dependency on each and every one of the independent claims or concepts presented, and xiv) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim v. Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 25 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A hydrocarbonaceous material upgrading method comprising the steps of:

inputting a hydrocarbonaceous feedstock that has diluent therein into vaporization equipment to generate a first bottoms, wherein said first bottoms is a vaporization bottoms that is substantially unpumpable at pipeline conditions and has a first viscosity, a first density, a vaporization bottoms weight, and a pour point;

inputting said first bottoms into a reactor at an input rate;

heating, at an operating pressure, and with a heater that is inside said reactor, said first bottoms to a reactor temperature and for a residence time, wherein said reactor temperature is from and including 720° F. to 760° F. and at least a first hydrocarbonaceous material constituent boiling point temperature;

vaporizing, under said operating pressure, at least some of said first bottoms to produce a first mass of hydrocarbonaceous material vapor;

producing, through chemical reactions, a second mass of hydrocarbonaceous material vapor whose condensation point temperature is equal to or less than said first hydrocarbonaceous material constituent boiling point temperature, wherein said first and second masses of hydrocarbonaceous material vapors have a combined partial pressure;

generating a second bottoms having a bottoms viscosity that is greater than said first viscosity, and a bottoms density that is greater than said first density;

admitting to said reactor a sparge gas that reduces said combined partial pressure of said first and second masses of hydrocarbonaceous material vapors in said reactor;

removing at least a portion of said first and second masses of hydrocarbonaceous material vapors from said reactor through action of said sparge gas;

forming a hydrocarbonaceous material condensate from said at least said first and second mass of hydrocarbonaceous material vapors; and removing said second bottoms from said reactor at a second bottoms removal, wherein said operating pressure is compatible with ancillary equipment that is external of said reactor, wherein the liquid mass amount of said second bottoms in said reactor depends on said input rate, said second bottoms removal rate, and the mass amounts of each of said first and second masses of hydrocarbonaceous material vapors, wherein said residence time is sufficient to allow at least some of said chemical reactions and is related to said reactor feed rate, said second bottoms removal rate, and to said liquid mass amount in said reactor, wherein said reactor is a continuous feed, single pass reactor, wherein said hydrocarbonaceous material condensate has a second viscosity that is less than said first viscosity, and a second density that is less than said first density, wherein said hydrocarbonaceous material condensate has a lower average molecular weight and lower average boiling point temperature than said second bottoms and said first bottoms, wherein the weight of said hydrocarbonaceous material condensate, relative to said vaporization bottoms weight, is proportional to said reactor temperature, said residence time, and said operating pressure, wherein said second bottoms does not meet crude oil pipeline specification, wherein said hydrocarbonaceous material condensate weight is at least 40% of said vaporization bottoms weight, wherein said second density and said second viscosity of said hydrocarbonaceous material condensate are each substantially independent of said reactor temperature and said residence time, and wherein said hydrocarbonaceous material condensate meets crude oil pipeline specification.

2. A hydrocarbonaceous material upgrading method as described in claim 1 wherein said chemical reactions comprises pyrolysis reactions.

3. A hydrocarbonaceous material upgrading method as described in claim 1 wherein said residence time is from 0.5 to 8 hours.

4. A hydrocarbonaceous material upgrading method as described in claim 1 wherein said ancillary equipment that is external of said reactor comprises equipment that processes said input feed and effluent streams to and from said reactor.

5. A hydrocarbonaceous material upgrading method as described in claim 1 wherein said ancillary equipment that is external of said reactor comprises equipment that conveys said input feed and effluent streams to and from said reactor.

6. A hydrocarbonaceous material upgrading method as described in claim 1 wherein said operating pressure is from vacuum to 35 psig.

7. A hydrocarbonaceous material upgrading method as described in claim 1 further comprising the step of inputting an antifoaming agent into said reactor.

8. A hydrocarbonaceous material upgrading method as described in claim 7 wherein said first bottoms, said antifoaming agent, and said sparge gas are the only inputs into said reactor.

9. A hydrocarbonaceous material upgrading method as described in claim 1 wherein said first bottoms and said sparge gas are the only inputs into said reactor.

10. A hydrocarbonaceous material upgrading method as described in claim 1 wherein said hydrocarbonaceous material condensate is blended with a blending stock that is different from said hydrocarbonaceous feedstock to yield a more marketable blended product than said condensate or blending stock alone, said more marketable blended product meeting said crude oil pipeline specification.

11. A hydrocarbonaceous material upgrading method as described in claim 10 wherein said other oil comprises crude oil.

12. A hydrocarbonaceous material upgrading method as described in claim 1 wherein said step of inputting comprises the step of continuously inputting, said step of removing at least a portion of said first and second masses of hydrocarbonaceous material vapors from said reactor comprises the step of continuously removing said at least a portion, and said step of removing said material second bottoms from said reactor comprises the step of continuously removing said second bottoms.

13. A hydrocarbonaceous material upgrading method as described in claim 1 wherein said step of admitting to said reactor a sparge gas comprises the step of admitting natural gas to said reactor.

14. A hydrocarbonaceous material upgrading method as described in claim 1 wherein said step of heating said first bottoms to a reactor temperature and for a residence time comprises the step of heating with a single heater.

15. A hydrocarbonaceous material upgrading method as described in claim 1 wherein said step of heating said first bottoms to a reactor temperature and for a residence time comprises the step of heating with at least two heaters, at least one of which is a recycle heater.

16. A hydrocarbonaceous material upgrading method as described in claim 1 wherein said residence time is proportional to said reactor feed rate, said second bottoms removal rate, and to said liquid mass amount in said reactor.

17. A hydrocarbonaceous material upgrading method as described in claim 1 wherein said step of heating said first bottoms to a reactor temperature and for a residence time comprises the step of heating, in said reactor, said first bottoms to said reactor temperature.

18. A hydrocarbonaceous material upgrading method as described in claim 1 and further comprising the step of adding said hydrocarbonaceous material condensate to a second substantially unpumpable crude oil amount so as to produce a hydrocarbonaceous material whose viscosity and density substantially meet oil pumping viscosity and density specifications.

19. A hydrocarbonaceous material upgrading method as described in claim 1 further comprising the steps of:

heating said second bottoms to at least a second hydrocarbonaceous material constituent boiling point temperature that is higher than said first hydrocarbonaceous material constituent boiling point temperature;

vaporizing at least some of said second bottoms to produce a third mass of hydrocarbonaceous material vapor;

producing, through chemical reaction, a fourth mass of hydrocarbonaceous material vapor whose condensation point temperature is equal to or less than said second hydrocarbonaceous material constituent boiling temperature; and generating a third bottoms.

20. A hydrocarbonaceous material upgrading method as described in claim 19 wherein said step of forming a hydrocarbonaceous material condensate from at least said first and second mass of hydrocarbonaceous material vapors comprises the step of forming a hydrocarbonaceous material condensate from at least said first, second, third and fourth masses of hydrocarbonaceous material vapors.

21. A hydrocarbonaceous material upgrading method as described in claim 1 further comprising the steps of serially repeating the group of said steps of heating, vaporizing, producing and generating, where each subsequently performed group of said steps acts on a liquid bottoms generated by an immediately prior group of said steps.

22. A hydrocarbonaceous material upgrading method as described in claim 21 wherein each of said group of steps is performed, at least in part, in a different reactor.

23. A hydrocarbonaceous material upgrading method as described in claim 22 wherein condensate streams from said different reactors are combined into a combined condensate stream.

24. A hydrocarbonaceous material upgrading method as described in claim 21 wherein said group of said steps is repeated until it costs more to conduct said repeated group of said steps than is the economic value of the yield of said repeated group of said steps.

25. A hydrocarbonaceous material upgrading method as described in claim 1 wherein said hydrocarbonaceous feedstock comprises extra heavy oil.

26. A hydrocarbonaceous material upgrading method as described in claim 1 wherein said hydrocarbonaceous feedstock comprises bitumen.

27. A hydrocarbonaceous material upgrading method as described in claim 1 further comprising the step of coking at least a portion of said second bottoms.

28. A hydrocarbonaceous material upgrading method as described in claim 27 wherein said step of coking said at least a portion of said second bottoms comprises the step of continuously coking at least a portion of said second bottoms with a continuous coker.

29. A hydrocarbonaceous material upgrading method as described in claim 27 wherein said step of coking at least a portion of said second bottoms comprises the step of effecting a high severity reaction.

30. A hydrocarbonaceous material upgrading method as described in claim 1 wherein said hydrocarbonaceous feedstock comprises an unpumpable crude oil.

31. A hydrocarbonaceous material upgrading method as described in claim 1 wherein said hydrocarbonaceous material condensate has a condensate weight that is at least 45% said vaporization bottoms weight.

32. A hydrocarbonaceous material upgrading method as described in claim 1 wherein condensate streams are combined to form a combined condensate stream.

33. A hydrocarbonaceous material upgrading method as described in claim 1 wherein said chemical reactions comprises low to medium severity chemical reactions.

34. A hydrocarbonaceous material upgrading method as described in claim 1 wherein said step of inputting a hydrocarbonaceous feedstock that has diluent therein into vaporization equipment comprises the step of inputting a hydrocarbonaceous feedstock that includes diluent therein into flash vaporization equipment.

35. A hydrocarbonaceous material upgrading method as described in claim 1 wherein said step of inputting a hydrocarbonaceous feedstock that has diluent therein into vaporization equipment comprises the step of inputting a hydrocarbonaceous feedstock that includes diluent therein into distillation equipment.

* * * * *